US006774793B1

(12) United States Patent
Brauer et al.

(10) Patent No.: US 6,774,793 B1
(45) Date of Patent: Aug. 10, 2004

(54) DEACTIVATING ELEMENT FOR MAGNETIC MARKER AND METHOD OF MAKING SAME

(75) Inventors: Stephan F. Brauer, Montreal (CA); Thomas Lebeau, Montreal (CA); John Strom-Olsen, Westmount (CA)

(73) Assignee: MXT Inc., Montreal (CA)

( * ) Notice: Subject to any disclaimer, the term of this patent is extended or adjusted under 35 U.S.C. 154(b) by 0 days.

(21) Appl. No.: 10/182,717

(22) PCT Filed: Feb. 25, 2000

(86) PCT No.: PCT/CA00/00198

§ 371 (c)(1),
(2), (4) Date: Aug. 9, 2002

(87) PCT Pub. No.: WO01/63577

PCT Pub. Date: Aug. 30, 2001

(51) Int. Cl.[7] ..... G08B 13/14

(52) U.S. Cl. ..... 340/572.3; 340/572.1; 340/572.6; 235/493

(58) Field of Search ..... 340/572.1, 572.3, 340/572.4, 572.6; 235/493, 91 M, 128

(56) References Cited

U.S. PATENT DOCUMENTS

| | | | | | |
|---|---|---|---|---|---|
| 4,568,921 | A | * | 2/1986 | Pokalsky | 340/572.3 |
| 5,121,106 | A | * | 6/1992 | Kataria et al. | 340/572.6 |
| 5,831,532 | A | * | 11/1998 | Gambino et al. | 340/572.1 |
| 6,121,879 | A | * | 9/2000 | Lian et al. | 340/572.3 |

FOREIGN PATENT DOCUMENTS

| | | |
|---|---|---|
| CA | 2181960 | 7/1996 |
| EP | 0756 255 | 7/1996 |

* cited by examiner

*Primary Examiner*—Toan N. Pham
(74) *Attorney, Agent, or Firm*—Ogilvy Renault

(57) ABSTRACT

A deactivating element for a magnetic surveillance marker has the form of a wire with substantially-circular cross-section in which alternating body segments are of a magnetizable material having a magnetic remanence of at least 0.2 Tesla and a non-magnetizable material respectively; the non-magnetizable material has a magnetic saturation of not more than 0.05 Tesla.

32 Claims, 3 Drawing Sheets

DEACTIVATING ELEMENT FOR MAGNETIC MARKER AND METHOD OF MAKING SAME

TECHNICAL FIELD

This invention relates to a deactivating element for a magnetic surveillance marker, a method of manufacturing the deactivating element, and a deactivatable magnetic marker incorporating the deactivating element.

BACKGROUND ART

Magnetic type article surveillance systems are known wherein markers containing highly permeable magnetic elements are affixed to articles to be protected from theft, such that when the articles are introduced to an interrogation zone the marker causes a detectable magnetic field disturbance which is used to activate an alarm. Such markers commonly additionally include a deactivating element which renders the marker either detectable or undetectable, depending on the state of its magnetization.

Such magnetic surveillance systems monitor the removal or passage of articles from a protected area such as a site of purchase of the articles as in a store, or a site of use of the articles as in a reference library.

Exit from the protected area involves passage through the interrogation zone which detects the presence of the marker on the article if the article is being improperly removed from the protected area.

Deactivation of magnetic electromagnetic article surveillance is described in U.S. Pat. No. 3,747,086, which describes the operating principle of a deactivatable electromagnetic marker, and the general magnetic properties of the constituent magnetic elements.

Prior markers are comprised of one or more elongated pieces of highly permeable, easily saturatable magnetic material which form the "detected element" in close proximity to one or more deactivating elements of low permeability, magnetically semi-hard material which form the "deactivating element". When the deactivating element is magnetized, it carries a remanent magnetic flux which saturates the nearby soft magnetic element, at least in some regions, in such a way as to make the soft magnetic element undetectable in the interrogation device employed in the interrogation zone.

Prior manifestations of deactivating elements may be categorized into four classes. First, and most simply, the deactivating element consists of one continuous strip of semi-hard magnetic material which is very nearly the same length as the detected element within the marker. In order to deactivate such a marker, a DC magnetic field is applied sufficient to saturate the semi-hard material of the deactivating element. The deactivation element thereafter acts like a single bar magnet where the magnetic flux generated is adequate to locally saturate or magnetically bias the detected element, making the detected element undetectable in the interrogation device.

Deactivating elements of this class are described in U.S. Pat. Nos. 3,747,086; RE32,427 (U.S. Pat. No. 4,298,862); U.S. Pat. No. RE32,428 (U.S. Pat. No. 4,484,184); U.S. Pat. Nos. 5,401,584; 4,857,891 and 5,181,021.

In a second class, the deactivating element is again a continuous strip of semi-hard magnetic material which is very nearly the same length as the detected element in the marker. In this class, however, deactivation is achieved by magnetizing the semi-hard material in such a way as to create a pattern of alternating magnetic dipoles within the material. Where like ends of these dipoles meet, magnetic flux is forced out from the material sufficiently to saturate the nearby detected element, making the detected element undetectable in the interrogation zone.

The principle problem with deactivation elements of this class is that a complex deactivating tool is required to create the necessary pattern of magnetization within the deactivating element, and the use of such a tool requires passing the marker in near contact to the tool, with a carefully controlled orientation and direction of travel. In addition, such deactivation elements tend to be costly because magnetic material of rather high magnetic coercivity and remanence is required to retain the magnetization pattern, and generate adequate deactivating flux.

Deactivating elements of this second class are described in U.S. Pat. Nos. 4,568,921; 4,665,387 and 4,684,930.

In the third class, the deactivation element contains multiple pieces of semi-hard material, each of significantly shorter length than the detected element, and distributed more-or-less uniformly along the length of the detected element. A marker using such a deactivating element is deactivated by applying a sufficiently large magnetic field to saturate the semi-hard pieces comprising the deactivating element, leaving them each magnetized.

The spaces between the separate pieces of semi-hard magnetic material play the important role of allowing the magnetic flux generated by the pieces to locally saturate the nearby detected element. These saturated regions effectively break up the magnetic continuity of the detected element and make it undetectable in the interrogation zone.

As compared to the other two classes, a cost saving is possible because less semi-hard material is required to achieve the same deactivation performance. An additional cost reduction is possible because a semi-hard material of a lower magnetic remanence may be used.

Examples of this third class of deactivating element include the use of flakes, chips and most commonly pieces of ribbon. The principle problem with manifestations of this class is that care must be taken to size and position the small flakes, chips or separate pieces of ribbon of semi-hard magnetic material along the marker, and to ensure their relatively uniform distribution. While material handling and placing solutions have been developed to address this problem, there remain limitations on the production rate and cost of such markers.

Deactivating elements of this third class are described in U.S. Pat. Nos. 5,121,106; 5,191,315; 5,246,522; RE32,427 (U.S. Pat. No. 4,298,862); U.S. Pat. No. RE32,428 (U.S. Pat. No. 4,484,184) and U.S. Pat. No. 5,146,204.

In a fourth class, the deactivating element is formed from a thin continuous strip of semihard magnetic material with length very nearly equal to the length of the detected element in the marker, the deactivating element being made of a material having magnetic properties which can be reduced by annealing. By heat treating the strip in local sections, it is possible to create regions with significantly reduced magnetic remanence. This has the effect of creating alternating magnetizable and non-magnetizable body segments within the mechanically continuous strip. In principle, this class of deactivating elements offers the handling and ease-of-application advantages of a continuous strip, and the magnetic advantages of separated magnetic pieces, allowing the magnetic flux from the magnetizable sections to more easily saturate the nearby detected element. An additional benefit is that deactivation is accomplished by simply applying a DC magnetic field of sufficient magnitude, and therefore a complex deactivating tool is not required.

In practice, these benefits have been difficult to realize for a number of reasons. First, commercially available semihard strip materials are costly, so it has been favorable to chop the strip and apply it to the detector material in spaced apart pieces, rather than bear the expense of annealed non-magnetic material separating the magnetic zones.

Also, given the importance of keeping the material of the deactivator and detector elements as close together as possible, the geometry of the strip deactivator is not well matched to a number of marker geometries, notably those where the detector material is of near circular cross section.

Furthermore, manufacturing processes proposed for strip deactivators of this class have difficulty ensuring uniform and reliable heating of localized sections of the strip. This is particularly true with electrical current heating, where the length of the annealed section must be significantly greater than the width of the strip annealed section to obtain relatively uniform current and heat distribution.

Further complications with the manufacture of strip deactivators include electrical contact problems, thickness variations causing non-uniform heating and twisting during spooling and application.

Deactivating elements of the fourth class are described in DE 19617582C2 and PCT/DE 98/02421.

DISCLOSURE OF THE INVENTION

This invention seeks to provide a deactivating element for a magnetic surveillance marker.

The invention further seeks to overcome this problems associated with the fourth class described hereinbefore.

The invention also seeks to provide a method of producing a deactivating element.

Still further the invention seeks to provide a deactivatable magnetic marker which includes a deactivating element of the invention.

Still further the invention seeks to provide a product label, tag or packaging, or an article of commerce having incorporated therein a deactivatable magnetic marker of the invention.

Thus in accordance with one aspect of the invention there is provided a deactivating element for a magnetic surveillance marker comprising: a wire having substantially circular cross section and consisting of a plurality of first and second alternating body segments, each of the first segments being of a magnetizable material having a magnetic remanence of at least 0.2 Tesla, and each of the second segments being of material having a magnetic saturation of not more than 0.05 Tesla.

In accordance with another aspect of the invention there is provided a deactivatable magnetic marker comprising: at least one detectable magnetic member adapted to provide a desired magnetic signal in combination with at least one deactivating element, said deactivating element, as magnetized, deactivating said magnetic member, the deactivating element being a deactivating element of the invention as defined hereinbefore.

In accordance with still another aspect of the invention there is provided a method of producing a deactivating element for a magnetic surveillance marker comprising: providing a wire having a substantially circular cross-section and comprised of a material capable of being physically modified, and physically modifying the material of said wire to render a plurality of first body segments of the wire magnetizable and having a magnetic remanence of at least 0.2 Tesla, while a plurality of second body segments of the wire have a magnetic saturation of not more than 0.05 Tesla, said first and second body segments being in adjacent, alternating relationship.

In further aspects of the invention there is provided a product label or tag, or a packaging of a product, or an article of commerce having incorporated therein a deactivatable magnetic marker of the invention.

DESCRIPTION OF BEST MODES i) Deactivating Element

The deactivating element may suitably be a metal wire of substantially circular cross section which has been treated or physically modified so as to comprise a plurality of magnetizable body segments and a plurality of non-magnetizable body segments, the magnetizable and non-magnetizable body segments being in alternating relationship. In this way each adjacent pair of magnetizable body segments is separated by a non-magnetizable body segment; and each adjacent pair of non-magnetizable body portions is separated by a magnetizable body portion along the length of the wire.

In this Specification magnetizable material means material having a magnetic remanence of at least 0.2 Tesla and non-magnetizable means having a magnetic saturation of not more than 0.05 Tesla. In particular, the magnetizable body segments are magnetically semi-hard having a coercivity in the range of 1 to 25 kA/m, preferably 2 to 10 kA/m.

In this Specification, substantially circular cross-section means a cross-section which is circular or nearly circular and having a curved outer face; as such references to diameter of the wire are not intended to indicate a true circular cross-section, but contemplate both circular and nearly circular cross-section.

The non-magnetic segments act as magnetic gaps where the magnetic flux generated by the magnetizable segments, when magnetized, is available to saturate the soft magnetic material of the detectable magnetic member.

Typically the metal wire has a diameter in the range of 0.05 mm to 0.5 mm, preferably 0.1 to 0.2 mm; the magnetizable body segments typically have a length of 2 to 15 mm; the magnetizable body segments are preferably longer than the non-magnetizable body segments and generally the length of the magnetizable body segments is 120% to 200% of the length of the non-magnetizable body segments. The lengths of individual magnetizable body segments within a wire may be the same or different; and the lengths of individual non-magnetizable body segments may be the same or different. Preferably the length of the magnetizable body segments are the same; and the lengths of the non-magnetizable body segments are the same within a wire. If more than one wire is employed in conjunction with a detectable magnetic marker, the lengths of the magnetizable body segments in a first wire need not be the same as the lengths of the magnetizable body segments in a second wire or other wire of the marker. Likewise, the lengths of the non-magnetizable body segments in the first wire need not be the same as the lengths of the non-magnetizable body segments in a second or other wire of the marker.

The deactivating element may be formed from a weakly magnetic alloy steel; in a particular embodiment the deactivating element is formed from a cold drawn 304 stainless steel wire (classification of the American Iron and Steel Association). In other embodiments the deactivating element is formed from a wire of an iron or cobalt rich alloy with semihard magnetic properties.

In comparison with the strip deactivators described in the fourth class above, the wire deactivator of the present invention has a number of advantages.

First, a wire deactivator of circular or nearly circular cross section allows placement of the deactivation material closer to the detection material for a number of marker geometries, notably those where the detection element itself is of circular or near-circular cross section. For example, a thread-like detection element can be conveniently wrapped around a circular wire deactivator.

Additionally, some near-circular thread-like detection elements require less magnetic flux for deactivation than ribbon detection elements.

The reduction in required magnetic flux, combined with the closer proximity of the deactivating element of the invention to a circular or nearly circular detection element, allows the use of a deactivation material for the deactivating element having a lower magnetic remanence, greatly expanding the range of potential deactivation materials.

Additionally, the materials designed for deactivation strips described in the fourth class above are generally available only as strip or sheet, but many materials with lower remanence are conveniently available in the form of a wire, at significantly lower cost.

Moreover, it has been found, in the present invention, that the wire form of some materials, notably cold-drawn alloy steel wires, has superior magnetic remanence compared with a strip form of the same material, thus providing more magnetic flux for deactivation per unit weight of deactivating material. The magnetic properties of these materials are closely tied with the state of internal strain and it appears that a more favorable distribution of strains occurs in a circular wire, as compared to a strip. Additionally, for these deactivation materials, circular wire is less costly than strip of the same material and cross sectional area.

An additional benefit of the wire deactivating element of the invention is that guiding and application of the wire deactivating element is simpler than for the strip deactivating element, since strip requires greater care in the prevention of twisting.

A further benefit of the wire deactivator is that it appears visually smaller than the strip deactivator, which is important for unobtrusive marking of retail goods and packaging.

ii) Method of Manufacture of Deactivating Element

The method of the invention involves fabrication of a wire with a substantially circular cross section, containing alternate segments of magnetizable and non-magnetizable material. This is accomplished by using a semihard magnetic material which can be rendered non-magnetic by heating to elevated temperatures. By heating a wire of such material in a plurality of separated segments along its length, the desired magnetic structure can be formed.

The heating may be effected by passing an electrical current, having a heating effect, through the spaced apart portions, or the local heating might similarly be achieved by laser radiation or electromagnetic discharge. In comparison to strip materials, the circular wire geometry lends itself to a more uniform distribution of heat throughout the cross section, and a correspondingly more uniform reduction of magnetic properties in the heated regions.

The preferred mode of heating is electrical current heating because, in principle, the heat can be applied uniformly, quickly and accurately to those volumes of the material where it is required. As compared with strip materials, this is much easier with wire of substantially circular cross section since it is easier to form electrical contact points of constant pressure and constant spacing along the length. Because the electrical contacts can be reliably made, efficient manufacturing of the wire deactivator is possible. The wire can be spooled at constant high speed over two fixed electrodes designed for the purpose, while the heating current is switched on and off. Because the contacts are reliable, the process results in a wire deactivation element with accurate length, accurate spacing and uniformity of the annealed non-magnetizable zones. This method of manufacture is more simple and reliable than any of those proposed for making strip deactivators.

Contact between the stationary electrodes and the travelling wire, is essentially point or line (a plurality of adjacent points) contact where the curved surface of the wire touches the contact surface of each electrode, as the travelling wire rides over the electrode contact surfaces. This produces a more efficient and uniform contact and heating of the wire, between the electrodes, than is achieved if a strip is employed instead of the wire. In the case of a strip, the contact between the face of the travelling strip and the contact faces of the electrodes would theoretically be a contact of high surface area. In practice, however, because the contact surface of the strip and the contact surfaces of the electrodes are not perfectly uniform, there is typically contact at two or more points in the opposed, facing surface of the strip and the electrodes, with different contact pressures at different points of contact; this results in non-uniform distribution of current in the strip and non-uniform heating.

An additional benefit to the wire deactivator is that guiding and spooling during manufacture are simplified, as compared with strip deactivators, since strip requires greater care in the prevention of twisting.

iii) Deactivatable Magnetic Marker

The deactivatable magnetic marker of the invention includes at least one detectable magnetic member which is adapted to provide a magnetic signal in an interrogation zone, in combination with at least one deactivating element of the invention. The deactivating element, when magnetized, deactivates the magnetic member such that the magnetic member does not provide the magnetic signal initialing an alarm signal; in the interrogation zone.

The detectable magnetic member is more especially of a soft magnetic material having a coercivity of less than 0.1 kA/m, for example, an amorphous metal having a value of magnetostriction close to zero. The soft magnetic material may be formed by rapid solidification of a molten ferromagnetic alloy.

The detectable magnetic member may suitably be in the form of one or more magnetic fibres, wires, strips or ribbons; the detectable magnetic member may comprise a magnetic element, for example, one or more magnetic fibres, strips or ribbons disposed in a non-magnetic carrier, for example, a plastic carrier; the carrier may be in the form of a yarn, thread, wire, sheath or strip in which the magnetic element is incorporated.

The detectable magnetic element may also be in the form of a thin film deposited on the deactivating element.

An especially preferred detectable magnetic element for use in conjunction with the deactivating element of the invention is the thread-like detection element described in PCT/CA 00/00050, filed Jan. 21, 2000, of MXT Inc. and Stephan Brauer.

It will be understood that the magnetic marker may comprise a single detectable magnetic member, for example, a wire, or a plurality of magnetic members, for example, fibres. Similarly the magnetic marker may comprise a single deactivating element or a plurality of such elements.

In the magnetic marker the detectable magnetic member and the deactivating element may be in physical engagement, for example, in the form of wires which are twisted together; or they may be in a non-contacting but closely spaced relationship, for example, they might be embedded in closely spaced relationship in a plastic carrier strip; if they are in non-contacting closely spaced relationship, they should be spaced apart less than 5 mm, preferably less than 2 mm and most preferably less than 1 mm.

The magnetic marker may be incorporated in a label or tag which is affixed to the article which is to be subject to the surveillance. Thus the marker may be incorporated in a garment label or tag which is securely affixed to the garment. The magnetic marker may also be incorporated in the packaging for the article.

The marker may also be directly incorporated in an article of commerce; for example, in the case of a garment, the marker may have a thread form and be threaded into the garment.

DESCRIPTION OF PREFERRED EMBODIMENTS WITH REFERENCE TO DRAWING

Figure 1:
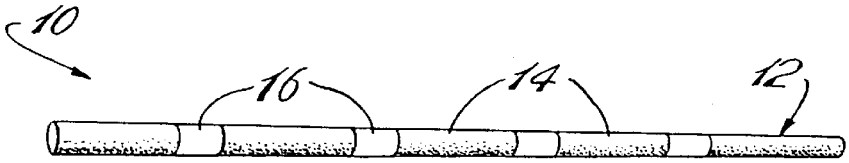
FIG. 1 is a schematic representation of a deactivating element of the invention.

With further reference to FIG. 1, a deactivating element 10 comprises a wire 12 having magnetizable segments 14, and non-magnetizable segments 16, the segments 14 and 16 being in alternating relationship.

Figure 2:
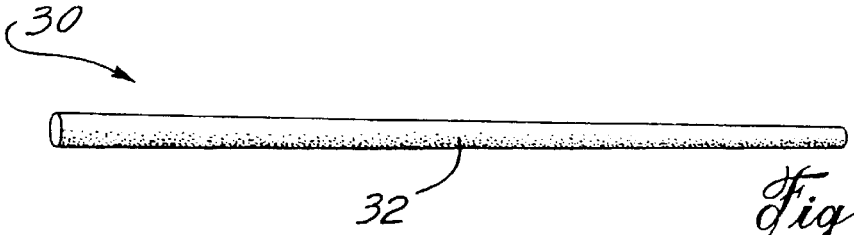
FIG. 2 illustrates schematically a detected element or deactivatable magnetic member of the invention, for use in a magnetic marker of the invention.

With further reference to FIG. 2, a detectable magnetic element 30 comprises a soft magnetic wire 32.

Figure 3:
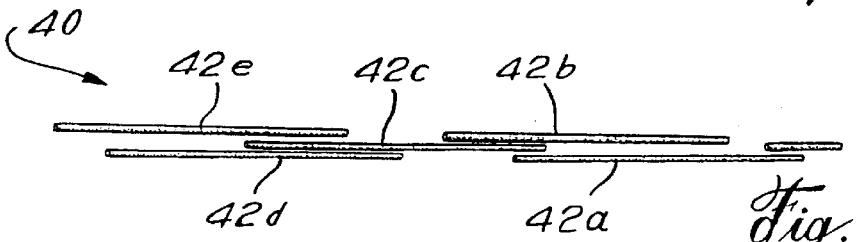
FIG. 3 illustrates schematically a detected element for use in magnetic marker of the invention, in the form of fibres.

With further reference to FIG. 3, a detectable magnetic element 40 is in the form of a plurality of soft magnetic fibres 42*a, b, c, d* and *e*.

Figure 4:
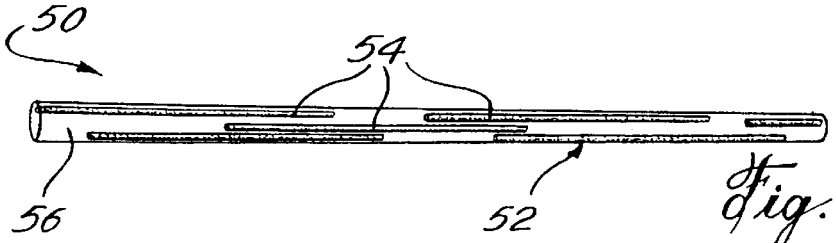
FIG. 4 illustrates schematically a detected element in the form of a composite wire, yarn or thread.

With further reference to FIG. 4, a detectable magnetic element 50 is in the form of a composite wire 52 which has soft magnetic fibres 54 embedded in a non-magnetic carrier 56, for example, a plastic wire, yarn or thread.

Figure 5:
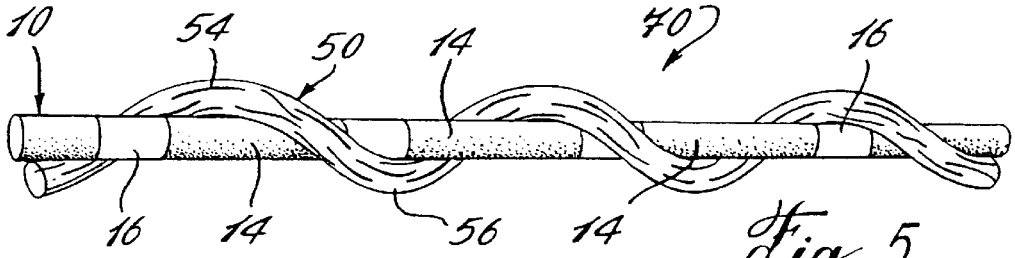
FIGS. 5, 6, 7 and 8 illustrate schematically deactivatable magnetic markers of the invention.

With further reference to FIG. 5, a deactivatable magnetic marker 70 has a deactivating element 10 of FIG. 1 and a detectable element 50 of FIG. 4. Composite wire 52 of detectable element 50 is wound spirally about wire 12 of deactivating element 10 and in typically contacting relationship therewith.

Figure 6:
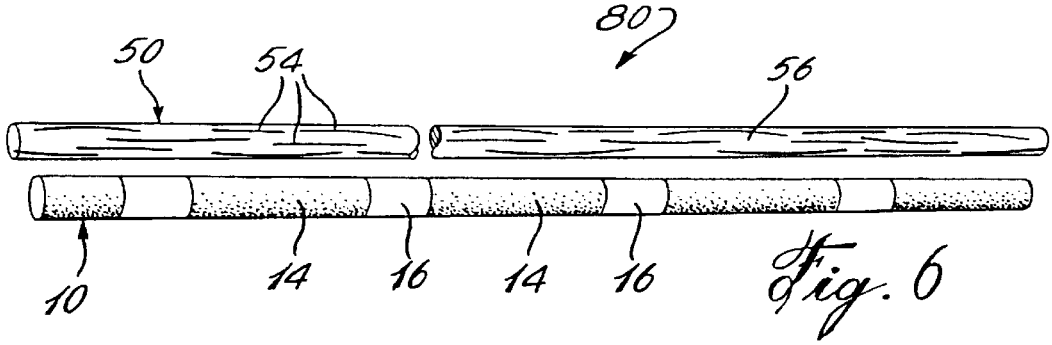

With further reference to FIG. 6, a deactivatable magnetic marker 80 has a deactivating element 10 of FIG. 1 and a detectable element 50 of FIG. 4. Elements 10 and 50 are in closely spaced apart side-by-side relationship; the elements 10 and 50 could also be in side-by-side contacting relationship.

Figure 7:
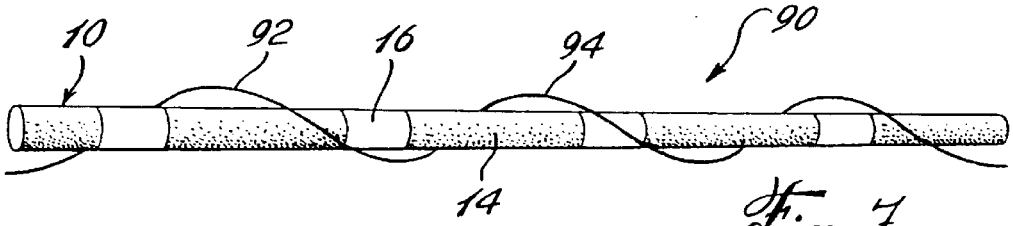

With further reference to FIG. 7, a deactivatable magnetic marker 90 has a deactivating element 10 of FIG. 1 and a detectable element 92 in the form of an elongate soft magnetic fiber 94; the fiber 94 is wound spirally about deactivating element 10 and is closely spaced therefrom although there may be parts of the spirally wound fibre 94 in contact with deactivating element 10.

Figure 8:
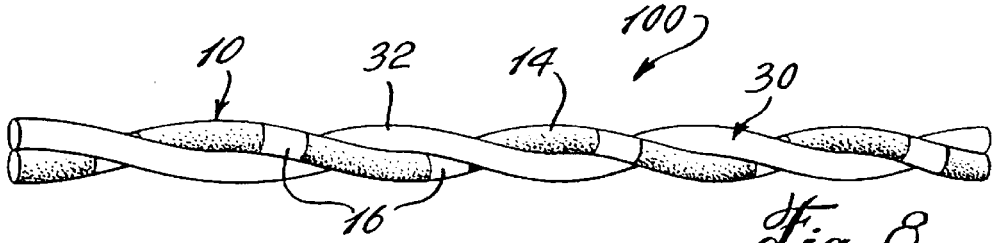

With further reference to FIG. 8, a deactivatable magnetic marker 100 has a deactivating element 10 of FIG. 1 and a detectable magnetic element 30 of FIG. 2, elements 10 and 30 being twisted together so that there are zones of contact and zones in which the elements 10 and 30 are closely spaced apart.

Figure 9:
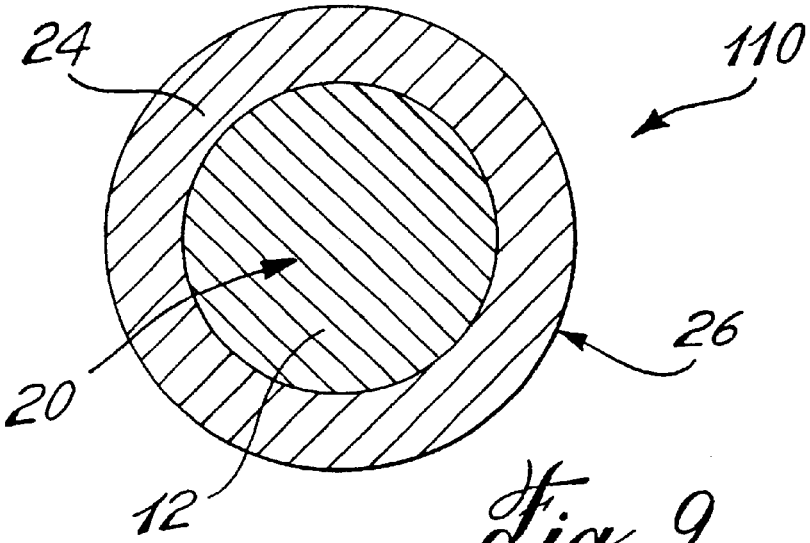
FIGS. 9 and 10 illustrates in cross-section magnetic markers of the invention.

With further reference to FIG. 9, a deactivatable magnetic marker 110 includes a deactivating element 20 comprising a wire 12 of FIG. 1 having a coating or sheath 24 of soft magnetic material forming a detectable magnetic element 26.

Figure 10:
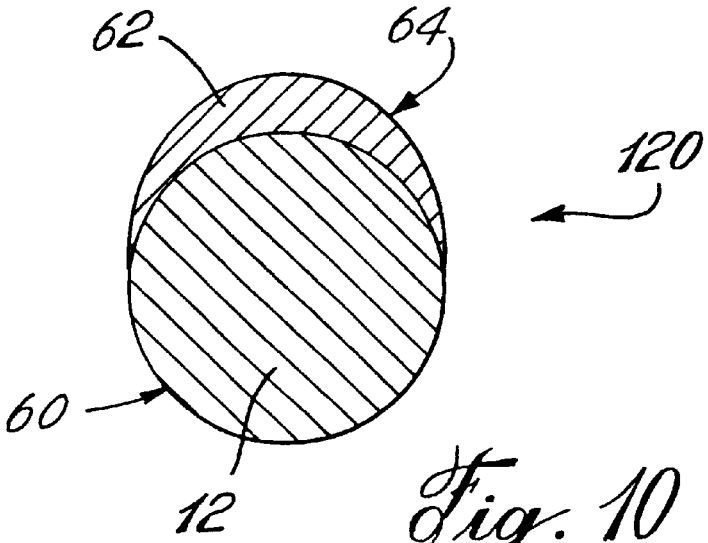

With further reference to FIG. 10, a deactivatable magnetic marker 120 includes a deactivating element 60 comprising a wire 12 of FIG. 1 having a coating 62 extending over part of the surface of wire 12, coating 62 being of soft magnetic material and forming a detectable magnetic element 64.

EXAMPLE

A cold drawn stainless steel wire of 0.1 mm diameter was locally annealed by passing an electrical current of 0.9 Amperes through 5 mm segments of the wire, with 5 mm unannealed lengths between these segments. The unannealed segments were kept cool by relatively massive metal contacts used to form the electrical connections on either side of the annealed segments.

Magnetic measurements were carried out on segments cut from the wire; it was found that the annealing treatment reduced the saturation magnetization from 0.77 Tesla to 0.006 Tesla and the magnetic remanence from 0.53 Tesla to 0.002 Tesla. With these magnetic properties reduced more than 100 times, the material in the annealed segments is effectively non-magnetizable. This wire employed as a deactivating element was found suitable for rendering amorphous metal fibres of 31 micrometer diameter undetectable by a commercial electronic article surveillance system.

What is claimed is:

1. A deactivating element for a magnetic surveillance marker comprising:

a wire of substantially circular cross section having a body consisting of a plurality of first and second alternating body segments, each of said first segments being of a magnetizable material having a magnetic remanence of at least 0.2 Tesla, and each of said second segments being of a material having a magnetic saturation of not more than 0.05 Tesla.

2. A deactivating element according to claim 1, wherein said second segments have a magnetic permeability of less than 100.

3. A deactivating element according to claim 2, wherein said magnetic permeability is less than 5.

4. A deactivating element according to claim 1, in which said first segments have a coercivity in the range of 2 to 10 kA/m.

5. A deactivating element according to claim 1, wherein said body is derived from a weakly magnetic alloy steel.

6. A deactivating element according to claim 1, wherein said body is derived from cold drawn 304 stainless steel.

7. A deactivating element according to claim 1, wherein said wire has a diameter of 0.05 mm to 0.5 mm.

8. A deactivating element according to claim 7, wherein said diameter is 0.1 to 0.2 mm.

9. A deactivating element according to claim 1, wherein each of said first segments has a length of 2 to 15 mm.

10. A deactivating element according to claim 9, wherein each of said first segments is of the same length.

11. A deactivating element according to claim 9, wherein each first segment is of a length which is 120% to 200% of the length of each second segment.

12. A deactivating element according to claim 1, wherein said body is of a semihard magnetic alloy.

13. A deactivatable magnetic marker comprising:

at least one detectable magnetic member adapted to provide a desired magnetic signal in combination with at least one deactivating element, said deactivating element as magnetized, deactivating said magnetic member, said deactivating element being a wire of substantially circular cross section having a body consisting of a plurality of first and second alternating body segments, each of said first segments being of a magnetizable material having a magnetic remanence of at least 0.2 Tesla, and each of said second segments being of a material having a magnetic saturation of not more than 0.05 Tesla.

14. A deactivatable magnetic marker according to claim 13, wherein said detectable magnetic member comprises a soft magnetic material.

15. A deactivatable magnetic marker according to claim 14, wherein said soft magnetic material is formed by rapid solidification of a molten ferromagnetic alloy.

16. A deactivatable magnetic marker according to claim 14, wherein said soft magnetic material is of an amorphous metal having a value of magnetostriction close to zero.

17. A deactivatable magnetic marker according to claim 16, wherein said magnetic member is in the form of at least one fiber, wire, strip or ribbon.

18. A deactivatable magnetic marker according to claim 13, wherein said magnetic member is in the form of at least one fiber, wire, strip or ribbon.

19. A deactivatable magnetic marker according to claim 13, wherein said magnetic member comprises a magnetic element disposed in a non-magnetic carrier.

20. A deactivatable magnetic marker according to claim 19, wherein said carrier is in the form of a yarn, thread, wire, sheath or strip.

21. A deactivatable magnetic marker according to claim 13, comprising a plurality of said at least one deactivating element.

22. A deactivatable magnetic marker according to claim 13, comprising a plurality of said at least one detectable magnetic member.

23. A deactivatable magnetic marker according to claim 13, wherein said detectable magnetic member comprises a thin film deposited directly on said deactivating element.

24. A product label, tag or packaging having incorporated therein a deactivatable magnetic marker according to claim 13.

25. An article of commerce having incorporated therein a deactivatable magnetic marker according to claim 13.

26. A method of producing a deactivating element for a magnetic surveillance marker comprising:

providing an a wire or substantially circular cross section of a material capable of being physically modified, and physically modifying the material of said wire to render a plurality of first body segments of the wire magnetizable and having a magnetic remanence of at least 0.2 Tesla while a plurality of second body segments of the wire have a magnetic saturation of not more than 0.05 Tesla, said first and second body segments being in adjacent, alternating relationship.

27. A method according to claim 26, wherein the physical modification comprises:

i) cold working the wire to render the material of the member magnetizable throughout, and ii) heating a plurality of spaced apart portions of the cold worked wire to render the spaced apart portions non-magnetizable, with magnetizable portions therebetween.

28. A method according to claim 27, wherein the magnetizable portions between the spaced apart portions are maintained in a non-heated condition to maintain them magnetizable.

29. A method according to claim 27, wherein said elongate member is a wire and said cold working is cold drawing.

30. A method according to claim 27, wherein said heating is effected by passing a heating electrical current through said spaced apart portions.

31. A method according to claim 27, wherein said heating is by laser radiation.

32. A method according to claim 27, wherein said heating is by electromagnetic discharge.

* * * * *